United States Patent [19]

Pfister, Jr.

[11] Patent Number: 4,947,563

[45] Date of Patent: Aug. 14, 1990

[54] VEHICLE PLOW-SUSPENSION SHOCK-ABSORBER

[76] Inventor: Paul T. Pfister, Jr., R.R. 3, Box 568, Spruce Run Rd., Glen Gardner, N.J. 08826

[21] Appl. No.: 481,635

[22] Filed: Feb. 20, 1990

[51] Int. Cl.[5] ..... E01H 5/06

[52] U.S. Cl. ..... 37/231; 37/235

[58] Field of Search ..... 37/231, 234, 235, 236

[56] References Cited

U.S. PATENT DOCUMENTS

| | | | |
|---|---|---|---|
| 4,236,329 | 12/1980 | Hetrick | 37/231 |
| 4,244,122 | 1/1981 | Hetrick | 37/234 |
| 4,369,590 | 1/1983 | Miller | 37/231 |
| 4,821,435 | 4/1989 | Pester | 37/231 |
| 4,843,744 | 7/1989 | Jansen | 37/231 X |
| 4,907,358 | 3/1990 | Moore | 37/231 X |

*Primary Examiner*—Dennis L. Taylor
*Assistant Examiner*—J. Russell McBee
*Attorney, Agent, or Firm*—William T. Hough

[57] ABSTRACT

In a preferred embodiment, in the line of suspension of a snow plow when suspended during transit of a motor vehicle having the plow mounted typically on the front frame and bumper thereof, a shock attenuating device typically inclusive of a helical spring arranged to be compressed responsive to intermittent increased stress results from downward surges of the large mass of the snow plow and/or upward movement of the vehicle resulting from vehicular movement over bumps or other rough terrain, with the shock attenuating device being operatively connected in series with between upper and lower chains, the upper chain having its upper end connected to a vehicularly-mounted chain-retraction and extension mechanism for alternately lowering and raising the snow plow to plowing position and raising the snow plow to a transporting position, and the lower chain at its lower end(s) being connected supportably to the snow plow.

14 Claims, 4 Drawing Sheets

FIG. 1
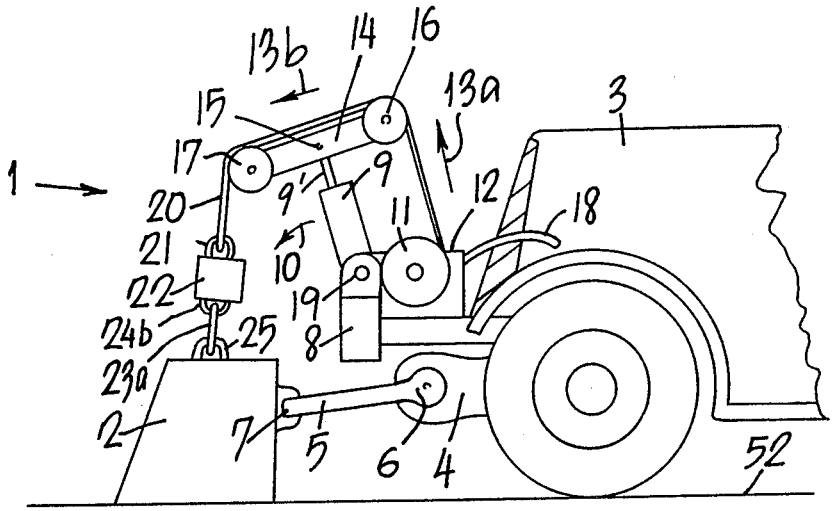
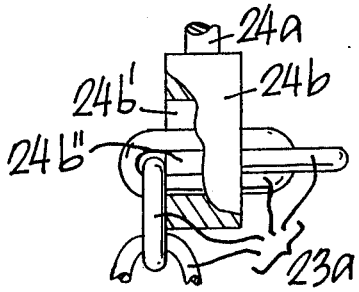
FIG. 1A
FIG. 2
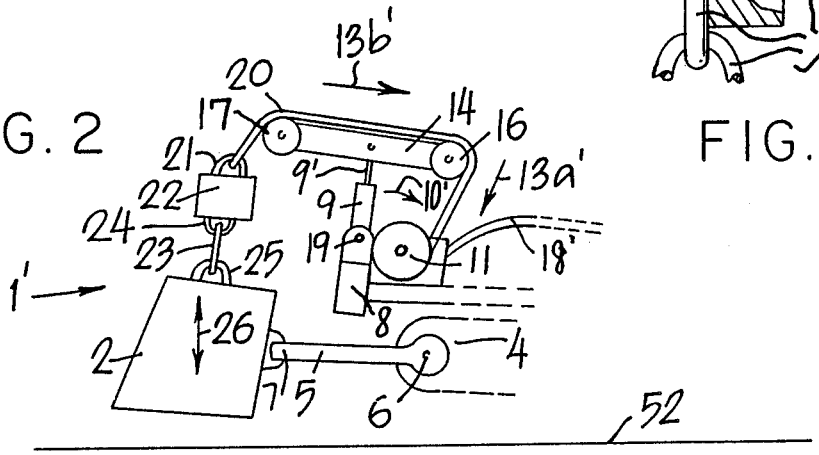
FIG. 10
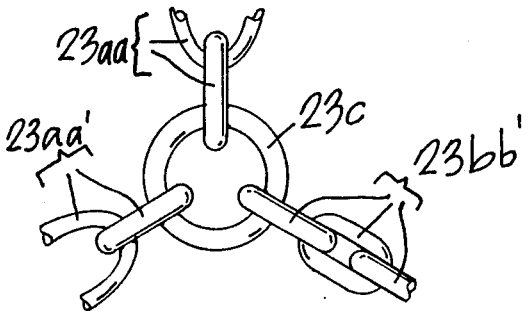

FIG. 12
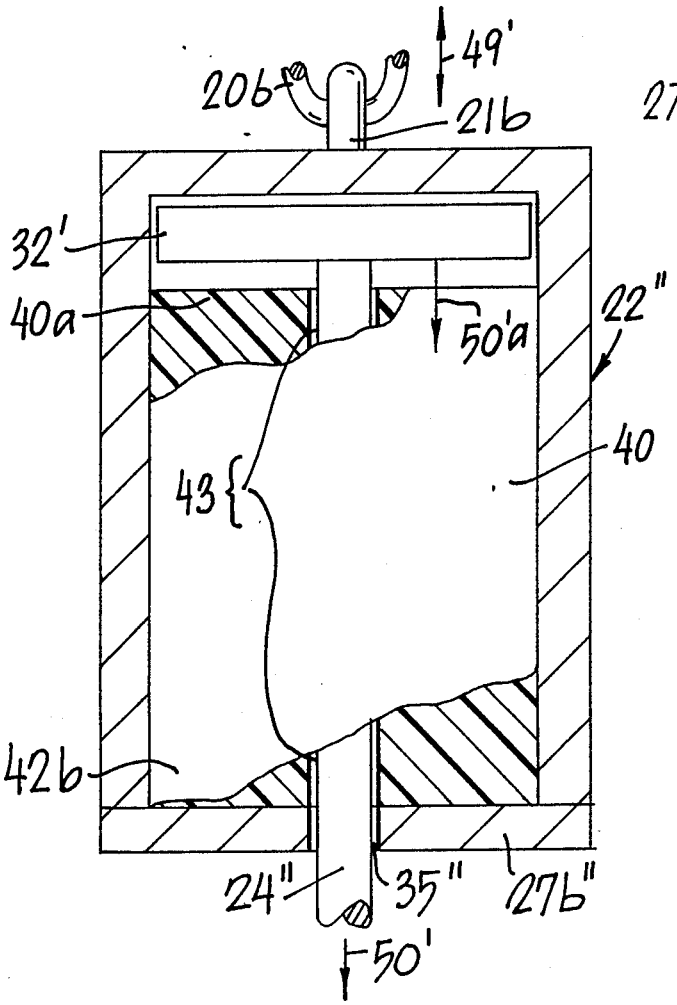
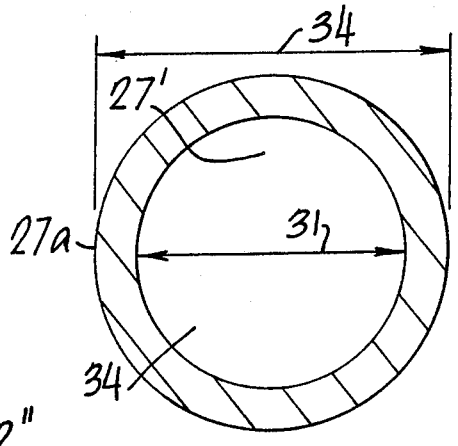
FIG. 7
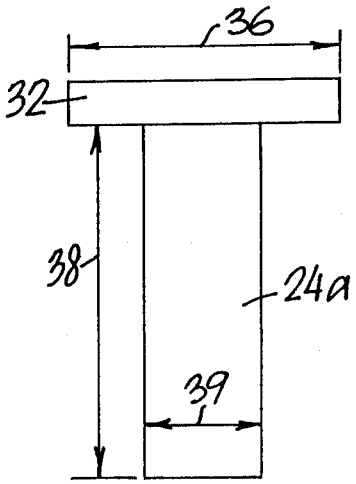
FIG. 8
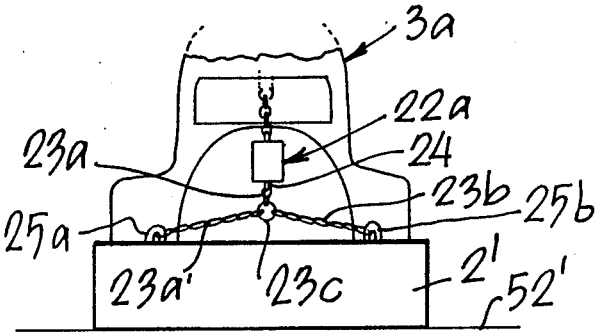
FIG. 14

VEHICLE PLOW-SUSPENSION SHOCK-ABSORBER

This invention is directed to a novel improvement in snow plow suspension equipment used to support a snow plow from front-frame and bumper support structure of a motor vehicle such as a truck or other appropriate vehicle.

PRIOR ART

By a prefiling prior art search, no relevant prior art was located, nothing having been found with regard to the problems encountered nor exhibiting nor teaching the present inventor's present critical arrangement(s). Non-relevant prior art utilizing, for example, springs to permit a lowered snow plow during use thereof to bounce upwardly and/or rearwardly and to be thereafter resiliently biased toward and returned to the fully-lowered plowing position include typically the Gottfried Reissinger U.S. Pat. No. 4,307,523 issued Dec. 29, 1981 exhibiting in FIG. 3 thereof resilient member 70 (identified as a spring), and Walter Hirt U.S. Pat. No. 3,587,182 issued June 28, 1971 exhibiting alternate spring actions of spring 17 in FIGS. 1 and 2 thereof, Albert Rath U.S. Pat. No. 4,359,794 granted Apr. 7, 1981 exhibiting a hydraulic cylinder in FIG. 3 thereof inclusive of an "extension" spring, and likewise F. Gettelman U.S. Pat. No. 1,957,771 exhibiting in FIGS. 1 and 3 thereof counter-balancing springs 35, and T. M. Bogenschutz U.S. Pat. No. 3,464,129 exhibiting in FIG. 2 its compression spring 85 for returning the blade to its plowing position after absorbing a plow during plowing. Accordingly, these being the sole typical prior art patents located, such patent have no relevance to the present invention as follows.

BACKGROUND TO THE INVENTION

Prior to the present invention, there have existed major and significant problems and difficulties with regard to snow plow front bumper support mechanisms for the support of the very heavy/massive snow plows suspended above the ground and/or snow during transit of the supporting vehicle such as a typically small truck commonly known, for example, as a pickup-truck, or the like. It is a common occurance that as the supporting truck or other motor vehicle travels over rough terrain during transit of the plow from one location to another when the plow is not in the plowing state and position and/or use, that bumpy terrain, ruts, holes and the like cause the chain-suspended or cable-suspended plow to bounce alternately upwardly and downwardly with its great weight/mass, with a resulting bending of the bumper and/or other support structure, and potentially breaking worn or previously-stretched chain and/or cable—with the potential hazard of causing major accidents of the transporting vehicle and/or other vehicles that might be in the vicinity if and when such breaks occur. Aside from potential bending and/or breaking of support structure and/or chain and/or cable, the major jerking potentially can interfere with steering, resulting also in the likelihood of steering accidents that could injure the driver and the vehicle as well as other vehicles and drivers in the vicinity during transit of the plow, particularly since the weather conditions are normally poor, involving snow and/or ice-laden street and highways.

SUMMARY OF THE INVENTION

The invention may be broadly defined as being a motor vehicle plow device for attenuating shock to a vehicle's vehicular support structure when a suspension mechanism is mounting a plowing blade structure thereon. The motor vehicle plow-device broadly comprises in combination: (1) a plowing blade structure having a predetermined large mass; (2) substantially upwardly-extending suspension mechanism mounted on the plowing blade structure for substantially downwardly suspending the plowing blade structure when the plowing blade structure is in a lifted suspended state and through which the plowing blade structure is alternately intermittently raised to a suspended position upwardly from and intermittently lowered from a suspended position downwardly to a predetermined plowing non-suspended position and state; and (3) the suspension mechanism including a vehicular mounting mechanism for mounting of the suspension mechanism on a retraction mechanism mounted on and supported by vehicular support structure of a motor vehicle such that the retraction means mounted on and supported on a vehicular support structure is alternately intermittently actuatable to lower the plowing blade structure downwardly from a suspended position toward or to a non-suspended position and alternately intermittently actuatable to raise the plowing blade structure upwardly from a non-suspended position to or toward a suspended position; with the present inventive improvement comprising (4) the suspension mechanism critically including each and both (a) separate opposite upper and lower ends jointly including opposing first and second compressing structures respectively, and (b) resilient mechanism compressably mounted therebetween such that the resilient mechanism becomes compressed when the above-noted upper and lower ends move apart from one-another while the plowing blade structure is in a lifted or suspended state and such that the resilient mechanism becomes expanded when the upper and lower ends move toward one-another. As a result of the improvement, intermittent shocks of intermittent gravitational pull on the large mass of the plowing blade structure in a lifted state for a motor vehicle's vehicular support structure mounting the resilient mechanism during movement of the motor vehicle over rough or bumpy terrain, is effectively and significantly attenuated by intermittent compressions of the resilient mechanism resulting from the intermittent shocks. The above-noted terminology means that the resilient mechanism must be in series with and in the direct line of support of the plowing structure, with and between the above-noted upper and lower ends, for the invention to be operative. Also critical, is the above-noted particular arrangement by which the spring (or other resilient mechanism and/or composition) is "compressed"—as opposed to stretching-out (expanding) a spring which by actual testing has been found to be a non-equivalent to the present invention. Spring-stretching arrangement results in excessive and uncontrolable bouncing-around of the suspended plow structure, causing additional and greater problems. As well, in the light of the great mass of such plowing structures such as snow plows, over-extension of the stretching spring constitutes a real and substantial hazard of the spring losing its resiliency by over-extension and/or such over-extension resulting in the plowing structure during elevated vehicular speeds accidentally and possibly fatally striking the pavement or other road surface or terrain, with a real potential hazard of causing the conveying motor vehicle to become wrecked with possible major or fatal injury to the driver and/or to injury to vehicles and/or drivers and/or passengers of other vehicles in the vicinity during travel over the hazardous normally trecherous snow and/or ice-laden roads or highways.

In a preferred embodiment of the motor vehicle plow-device as broadly above-described, the suspension mechanism further includes a flexible elongated structure having opposite proximal and distal ends; and additionally there is included a retraction mechanism mounted on the vehicular mounting mechanism as a part of a greater combination; and additionally the retraction mechanism is connected to the above-noted proximal end and the distal end is connected to the above-noted upper end; and the lower end is connected to the plowing structure. Thereby, the flexible elongated structure is at-least partially retractable to retract the distal end with a resulting lifting of the plowing blade structure to a suspended state.

In another preferred embodiment having enhanced utility, the above-noted lower end includes a fastening mechanism for detachably fastening onto the plowing blade structure by which the plowing blade structure is intermittently suspendable from the suspension mechanism when the retraction mechanism is in an at-least partially retracted state of the flexible elongated structure.

In another preferred embodiment, the resilient mechanism has opposite upper and lower portions, and the upper and lower ends are structured and positioned such that when the plowing blade structure is suspended as a result of at-least partial retraction, the upper end has a downwardly extending structure as the first compressing structure pressing critically upwardly against the resilient mechanism and the above-noted lower end has an upwardly extending structure as the second compressing structure pressing critically downwardly against the resilient mechanism to thereby exert critically compressing pressure on the resilient mechanism, such as on opposite faces of the resilient mechanism—typically on opposite ends of a helical spring.

In another preferred embodiment, the resilient mechanism includes such an above-noted helical compression spring positioned to be in an at-least partially compressed state between the downwardly extending structure and the upwardly extending structure when the retraction mechanism is in at-least partially retracted state sufficiently for the plowing blade structure to be suspended.

In another preferred embodiment, the fastening mechanism includes first attaching structure and an elongated blade-suspension structure having at least one blade-suspension end and having at an opposite end thereof a suspension-structure end; the suspension structure end is permanently affixed to the second compressing structure of the lower end, and the elongated blade-suspension structure is structured or constructed such that the end(s) thereof are attached or attachable to and supportably suspendable of the plowing blade structure. The elongated blade-suspension structure includes attaching structure intermittently engageable with the first attaching structure sufficiently for the fastening mechanism to support the plowing blade structure.

In another preferred embodiment, the elongated blade-suspension structure comprises a link chain, and the second attaching structure comprises a link of the link chain.

In another preferred embodiment, the above-noted suspending mechanism includes an air compression and valve structure for intermittent alternate air intake and compression and exhaust, responsive to alternate increases and decreases in stress exerted through the suspending mechanism during upward and downward bouncing movement of the plowing blade structure when the plowing blade structure is in a suspended state during movement of the conveying motor vehicle on which the vehicular mounting mechanism is mounted.

In another preferred embodiment, the resilient mechanism comprises a resilent compressible solid rubber composition positioned to be in an at-least partially compressed state between the downwardly extending and the upwardly extending structure when the retraction mechanism is in at-least partially retracted state sufficiently for the plowing blade structure to be suspended.

In another preferred embodiment, the suspension mechanism includes first and second suspension mechanisms, the first suspension mechanism including first upper and lower ends and the second suspension mechanism including second upper and lower ends, and the first suspension mechanism including a first flexible elongated structure having opposite first proximal end and separate first distal end. The second suspension mechanism includes a second flexible elongated structure having a second proximal end and a second distal end, with the plowing blade structure extending substantially laterally in opposite directions, and the plowing blade structure has a substantially mid-point intermediate between the above-noted opposite directions. Additionally there is included a retraction mechanism mounted on the vehicular mounting mechanism and the retraction mechanism is connected to each of the first and second proximal ends and the first, and second lower ends are connected to the the plow blade structure at substantially laterally spaced-apart positions or locations on the plowing blade structure as spaced substantially equally from the above-noted substantially mid-point. Thereby the first and second flexible elongated structures are each at-least partially retractable to retract the above-noted distal end with a resulting evenly balanced lifting of the plowing blade structure to a suspended state.

The invention may be better understood by making reference to the following Figures.

THE FIGURES

FIG. 1 illustrates diagrammatically in an in-part view the entire invention as mounted on a supporting motor vehicle such as typically a pick-up truck or the like, shown in side view with the forwardly-mounted plow structure lowered to the plowing position and state, also illustrating the position and functioning of the claimed improvement.

FIG. 1A illustrates a chain as the second attaching structure fastened within the first attaching structure suspended by a blade-suspension end of an elongated blade-suspension structure—the chain and the blade-suspension end each being shown in an in-part cutaway.

FIG. 2 illustrates diagrammatically the same in-part view as that of FIG. 1, devoid of showing as much of the motor vehicle, shown in side view with the forwardly-mounted plow structure raised to the transport position and state for the transporting of the plow when not plowing, also illustrating the position and functioning of the claimed improvement.

Figure 3:
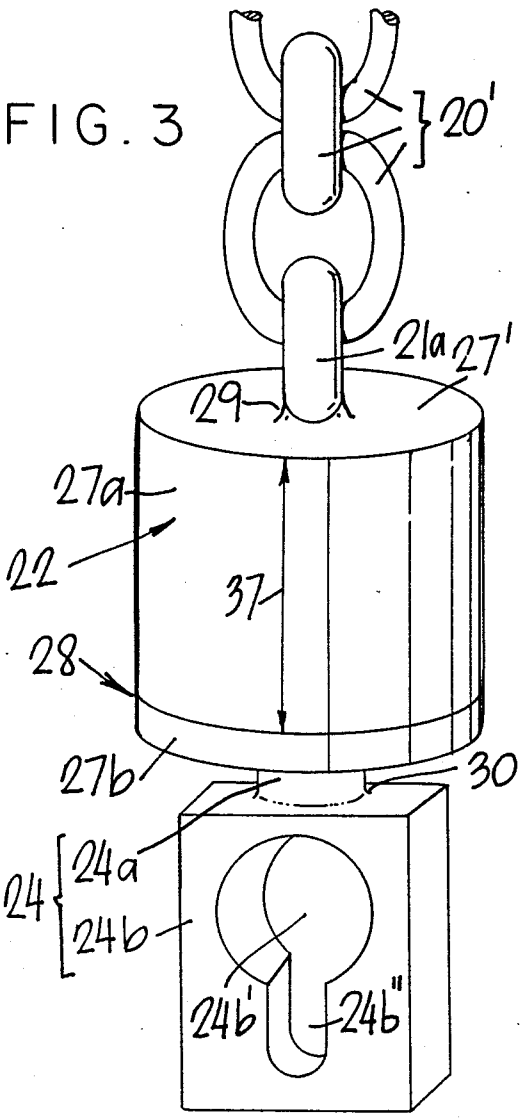

FIG. 3 illustrated diagrammatically in a side view, the claimed suspension mechanism detachably fastenable to the plow, here illustrating the first attaching structure and its blade-suspension structure, but devoid of the second attaching structure such as a plow-mounting chain.

Figure 4:
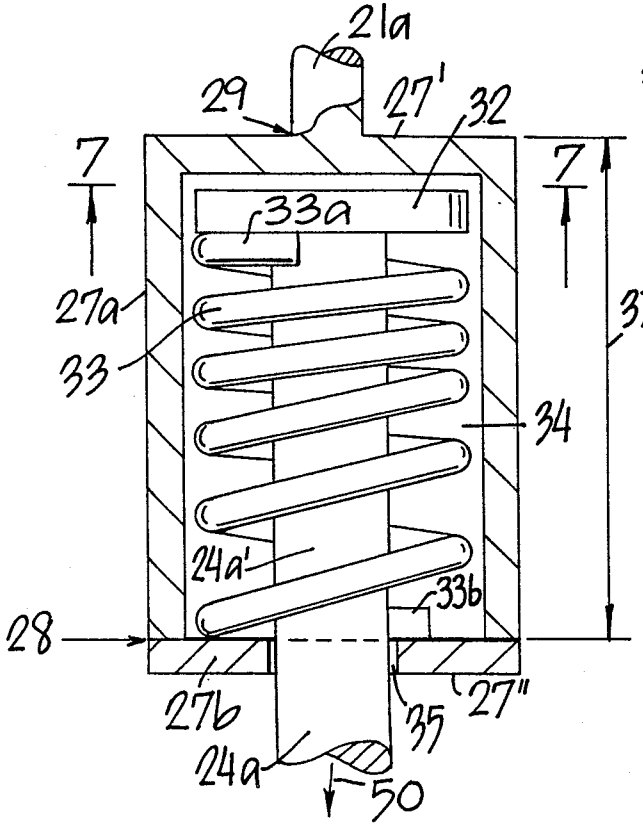

FIG. 4 illustrates diagrammatically an in-part side cross-sectional view, with partial cut-away, of the claimed suspension mechanism illustrated in foregoing Figures, employing a helical spring as the resilient mechanism.

Figure 5:
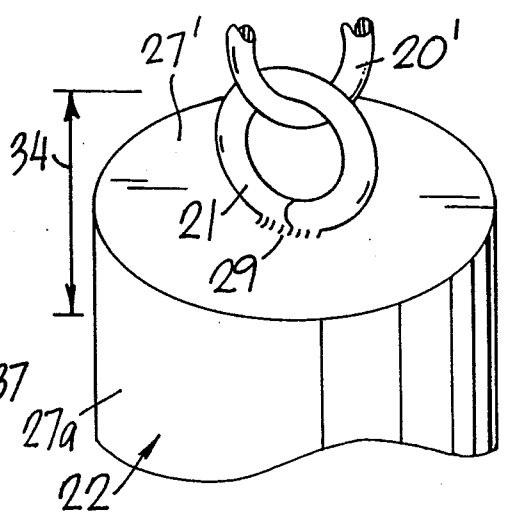

FIG. 5 illustrates diagrammatically an oblique top side in-part view of the claimed suspension mechanism and the distal end of the flexible elongated structure here shown as the attaching chain in an in-part view thereof.

Figure 6:
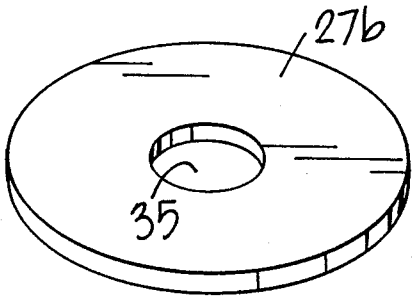

FIG. 6 illustrates diagrammatically a detached lower portion of the claimed suspension mechanism, in a bottom perspective view thereof.

FIG. 7 illustrates diagrammatically a cross-sectional view as taken along line 7—7 of FIG. 4.

FIG. 8 illustrates diagrammatically a side view of the suspension structure end of the elongated blade-suspension structure.

Figure 9:
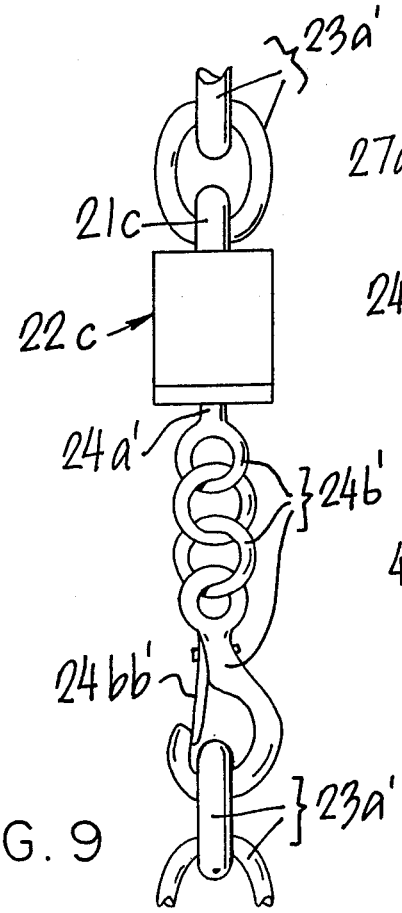

FIG. 9 illustrates diagrammatically an alternate embodiment illustrating an alternate equivalent first attaching structure, showing in-part view each of the second attaching structure (here the upper end of a plow-mounted chain) and the distal end of the flexible elongated structure (here the lower end of a chain).

FIG. 10 diagrammatically illustrates in part view, an alternate embodiment of the second attaching structure—here being an upwardly-extending chain suspending a two-pronged chain (i.e., supporting two lower diverging chains).

Figure 11:
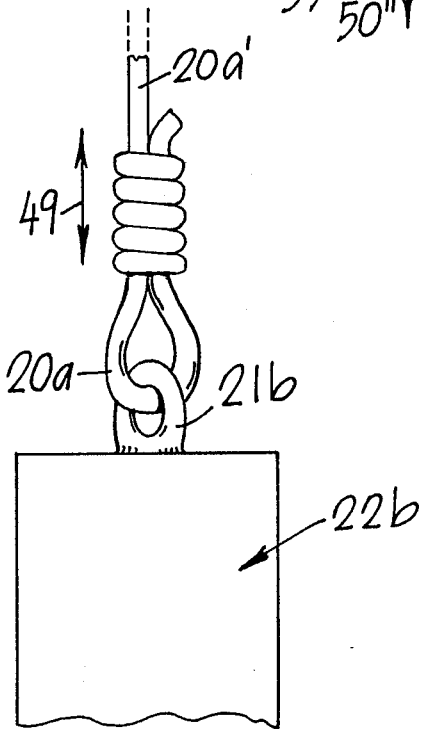

FIG. 11 illustrates diagrammatically an alternate embodiment typically utilizing a cable as the distal end of the flexible elongated structure attached at its lower end (distal end) to the upper end of the claimed suspension mechanism.

FIG. 12 illustrates diagrammatically an alternate embodiment in which a firm but resilient rubber or plastic is employed as the resilient mechanism, the suspension mechanism being in side cross-sectional view and the resilient mechanism and the suspension structure end each being shown in partial cut-away.

Figure 13:
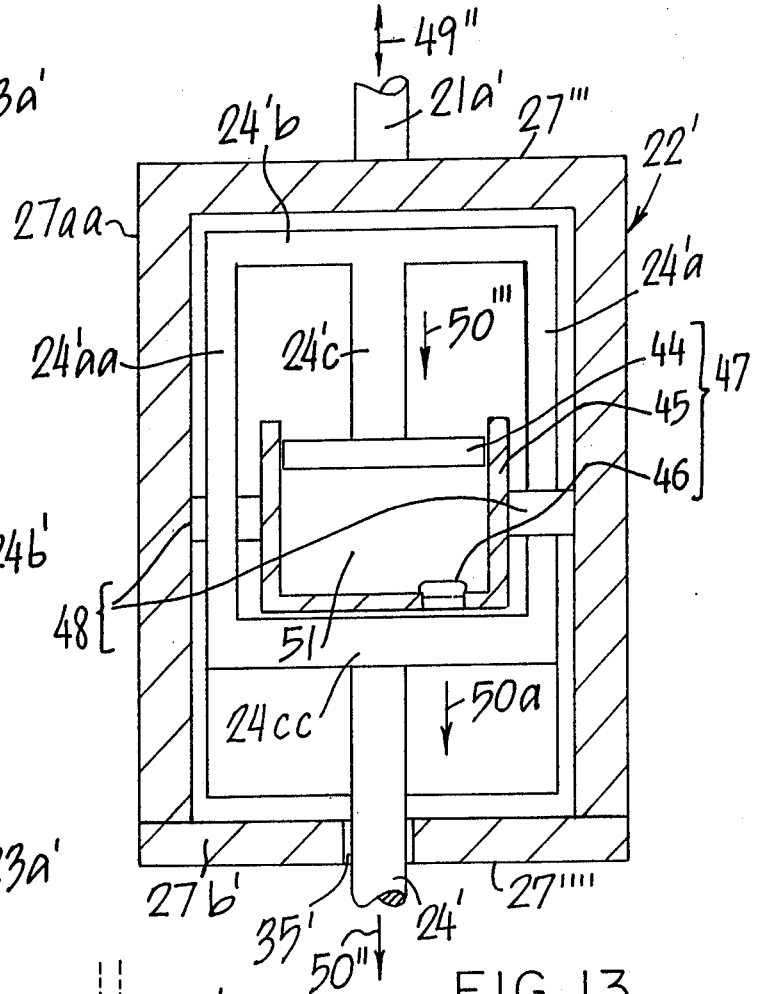

FIG. 13 illustrates diagrammatically another alternate embodiment inclusive of a hydraulic pneumatic structure by which air sucked into the inner space is utilized is a compressible state as the suspension mechanism, illustrated in a cross-sectional view of the suspension mechanism and of part of the hydraulic pneumatic structure, illustrating the suspension structure being shown in partial cut-away view.

FIG. 14 illustrates diagrammatically a front view of the combination illustrated in the foregoing FIG. 1, with the plow in the lowered plowing state and position.

DETAILED DESCRIPTION

FIGS. 1, 1A, 2, 3, 4, 5, 6, 7, 8, 10 and 14 each and all represent differing views of a common embodiment, and accordingly all indicia thereof correspond exactly for commonly illustrated structures. Other Figures illustrate variations, and indicia for structures corresponding substantially in structure and function are accordingly related indicia to improve ease of understanding of the following disclosure below.

FIGS. 1 and 2 illustrate common side views of the same greater combination of the invention, including the supporting vehcicle 3, differing solely in the alternate positions and states of the FIG. 1 having the plow structure 2 in the unsupported or lowered position and state, and the FIG. 2 having the plow structure 2 in the raised supported and suspended state and position. In FIG. 1, the improvement combination 1, as broadly referred to, is illustrated in the uncompressed (non-compressed) state and condition present when the plow structure 2 is in the lowered plowing position for the plowing of snow, soil or the like. There are illustrated the suspension mechanism and structure collectively identified as 22 thereof, the suspension-structure end 24*b*, the elongated blade-suspension structure 23*a* attached to plow-mounted ring(s) 25 or the like, the flexible elongated structure 20 attached at its distal end to ring 21*a* that is welded or otherwise permanently attached (or affixed) to the upper end of the suspension mechanism's structure, the rigid pivot arm(s) 5 pivotably attached at one end to the plow pivot structure 7 and pivotably attached by an opposite pivot-structure end 6 to vehicle front-end undercarriage structure 4. Typically conventional pulley structures 17 and 16 mounted on opposite ends of the typically conventional retraction upper elongated structure 14 conventionally pivotally mounted by typically a conventional pin 15 securing the upper elongated structure 14 to the typically conventional alternately extendable and retractable hydraulic shaft 9′ of the typically conventional hydraulic cylinder 9 typically conventionally pivotably mounted by typically conventional pin 19 onto the vehicular bumper 8. Cable or chain retraction conventional reversible motor 12 carries its alternately reversably winding and unwinding spool or roller 11 controlled by conventional switch mechanism(s) not illustrated located typically within the cab of the truck from which typical electrical lead(s) 18 conventionally control and provide electrical power to the motor 12. As a result of the conventional mechanism, either (a) the shaft 9′ is intermittently alternately retracted and extended, and/or (b) the flexible elongated structure 20 is intermittently alternately moved in extension blade-lowering directions 13*a* and 13*b* and opposite retraction blade-lifting directions 13*a*′ and 13*b*′, with the pivoting support structure thereof typically moving in direction 10 during extension and in directions 10′ during retraction, as the plow structure is alternately intermittently lifted and lowered in alternate directions 26. The snow or other plow structure in its lowered state and position rests on the road or pavement or terrain surface 52. Alternatively, conventionally, flexible elongated structure 20 may be rigidly secured to elongated structure 14 at its forward end, devoid of pulley 17, and pulley 16 may be rigidly mounted on bumper 8 as a pivot for pivot structure 14 at the rearward end of pivot structure.

FIG. 3 illustrates in greater clarity and detail the preferred embodiment, better illustrating the conventional type link chain 20′ as the flexible elongated structure, and the suspension mechanism and structure thereof, jointly referred to as 22 having its integral upper tubular end 27*a* its typically welded doughnut-shaped bottom 27*b* welded at weld-line 28, and lower portion 24*a* (insofaras it can be seen in this Figure), and in detail the ring 21*a* typically welded to upper surface 27' at weld line 29, and the unitary structure 24 inclusive of the lower portions 24*a* typically welded to suspension structure end 24*b* typically at weld line 30. The suspension structure end 24*b* includes the shaped structure thereof forming the enlarged insertion space 24*b'* and typically a locking structure and slot-space 24*b''* thereof. Also illustrated is the typical and preferred length of the tubular upper portion (not including the doughnut disc thickness) of 2 inches.

FIG. 1A better described at this time and location in this disclosure, illustrates the some of the same structures discussed and described in the preferred embodiment of FIG. 3, additionally illustrating however the typical and preferred link chain of the above-noted elongated blade-suspension structure of FIGS. 1 and 2, with the FIG. 1A link chain having and illustrating the links 23*a* thereof positioned in a locked and suspended state by a chain link positioned within the locking slot 24'' and the next link therebeyond typically positioned so as to not be aligned with the locking slot whereby the link chain is locked into the suspension structure end 24*b*.

FIG. 4 illustrates a typical cross-sectional view of the suspension mechanism and structure thereof previously designated as combination structure 22 with its upper end 27*a* and lower end 27*b*. Additionally disclosed in this view is the tubular nature of the upper end comprised of its upper tubular structure 27*a* and its welded doughnut lower disc-like bottom 27*b* having lower surface 27'' and hole or aperture 35, and previously described 24*a* and its enlarged upper end 32 within space 34, having helical spring 33 mounted around the lower end portion 24*a'*, such that the helical spring is compresses and/or compressable between the enlarged upper end 32 against spring end 33*a* and the disc-like bottom 27*b* that is welded to the upper end 27*a*, against the spring end 33*b*. The helical spring 24*a'* becomes compressed when the ring 21*a* is lifted upward by retraction action of the motor 12 to lift the plow blade structure 2, thereby causing the spring to initially become compressed to a degree less than its total compressability, as the lower end 24 is thereby dragged downwardly in direction 50. When in the lifted state, again the helical spring becomes intermittently more compressed whenever the supporting carrier vehicle 3 travels over rough road, bumpy shown, or other rough terrain at which time again intermittently shock is absorbed as the lower end 24*a* is intermittently dragged downwardly by gravitational pull on the heavy and large massed snow plow structure and/or as the vehicle 3 is bounced-upwardly in movement relative to the lagging heavy plow structure, whereby the intermittent compression(s) serve to attenuate shock that otherwise would cause problems associated with prior art arrangements discussed above in the background discussion.

FIG. 5 better illustrates in a different and perspective top in-part view of the typical arrangement of the FIG. 3 link-chain 20' attachment to the ring 21 with its weld-line 29 attachment to the upper end 27*a* at its upper surface 27' for the suspension mechanism and structure thereof 22, together with illustrating its typical and preferred tubular outer diameter 34 as 2.25 inches.

FIG. 6 illustrates in perspective view the above described doughnut-shaped disc 27*b* with its through-space aperture or hole 35 with its typical and preferred diameter of slightly greater than 0.75 inch.

FIG. 7 illustrates a cross-sectional view as taken along line 7—7 of FIG. 4, with its typical and preferred inner diameter of 1.75 inches.

FIG. 8 illustrates a more complete view of the lower end of the embodiment of FIG. 3, prior to typical weld attachment of the fastening structure 24*b* of FIG. 3, here illustrating in side view the structure shown in FIG. 4 together with typical and preferred width and thickness and length dimensions thereof as 36, 38 and 39. It is noted that the lower structure of element 24*a* is normally in the shape of a cylindrically-shaped shaft, as is apparent from the view thereof in FIGS. 3 and 4. The member 32, typically circular in shape, has a diameter 36 of preferably 1.75 inches, and a thickness of 0.25 inches. The lower structure of the element 24*a* has a preferred length 38 of 2.5 inches and a diameter 39 of 0.75 inches.

FIG. 9 illustrates in side in-part view an alternate embodiment with regard to the lower end 24*a'* and resilient-snap elements 24*b'* with the flexible snap-blade 24*bb'* thereof, as snapped onto the link chain 23*a'*.

FIG. 10 illustrates in-part view, the preferred arrangement and combination for one or more embodiments illustrated in this disclosure, of the elongated blade-suspension structure including the upper suspending chain links 23*aa* and a supported ring member 23*c* and the two diverging link chains 23*aa'* and 23*bb'* diverging downwardly in opposite directions toward a snow plow structure supported thereby as typically shown in following FIG. 14.

FIG. 11 illustrates in in-part view an alternate embodiment of FIG. 3, in which the flexible elongated structure 20 is alternately a cable 20*a'* formed and bound to form the engaging loop portion 20*a* thereof thereby locking into the ring 21*b*.

FIG. 12 illustrates an alternate embodiment differing from that of FIGS. 3 and 4, in that in this embodiment shown in cross-section and partial cut-away there is substituted for the FIG. 4 helical spring, here an annularly-shaped resilient rubber and/or rubber composition 40 with its annulus-through hole 43. Any conventional hardened rubber having predetermined limited compressability sufficient to be compressed to some degree comparable to the FIG. 4 helical spring arrangement, while offering resistance excessive compressive compressability and softness and/or to any excessive degree of resiliency to an extent that would defeat the above-stated objects.

FIG. 13 illustrates another alternate embodiment as compared to the embodiment of FIG. 4 and the embodiment of FIG. 12, differing in that in this embodiment there is utilized a conventional type pneumatic compression cylinder 47 with its component parts inclusive of the piston compression disc-member 44 mounted on a cylinder shaft 24'*c*, movable within the space 51 of the cylindrically shaped cylinder-tube 45 having an air-intake one-way valve 46, and support spokes 48, such that the air within space 51 of the cylinder-tube 45 is intermittently compressible. The support beam members 24'*aa* and 24'*a* and upper beam member 24'*b* straddle and circumscribe the cylinder 47, with the lower beam 24*cc* being anchored to and moving with the lower end 24' responsive to alternate intermittent movements apart and toward one-another of the upper end 27*aa* and the lower end 24'.

FIG. 14 illustrates a front view of the embodiments illustrated in FIGS. 1, 2 and 10, but is also typically illustrative of other combination of alternate embodiments.

Accordingly, for any one or more embodiments of the above-disclosed invention, the resilient mechanism and structure thereof serves to attenuate shock and destructive and disruptive pressures on the motor vehicle and the bumper and other supporting structure thereof by attenuating such shocks and excessive stresses which otherwise cause aforestated problems and difficulties and hazards.

It is within the scope of the invention to make such variations and modifications and substitution of equivalents as would be apparent to a person of ordinary skill in the art.

I claim:

1. A motor vehicle plow-device for attenuating shock to a vehicle's vehicular support structure when a suspension means is mounting a plowing blade structure thereon, comprising in combination: a plowing blade structure having a predetermined large mass, substantially upwardly-extending suspension means mounted on said plowing blade structure for substantially downwardly suspending the plowing blade structure when the plowing blade structure is in a lifted suspended state and through which said plowing blade structure is alternately intermittently raised to a suspended position upward from and intermittently lowered from a suspended position downwardly to a predetermined plowing non-suspended position, and said suspension means including a vehicular mounting means for mounting of the suspension means on a retraction means mounted on and supported by vehicular support structure of a motor vehicle such that the retraction means mounted and supported on a vehicular support structure is alternately intermittently actuatable to lower the plowing blade structure downwardly from a suspended position toward or to a non-suspended position and alternately intermittently actuatable to raise the plowing blade structure upwardly from a non-suspended position to or toward a suspended position, the improvement comprising said suspension means including separate opposite upper and lower ends jointly include opposing first and second compressing structures respectively, and a resilient means compressibly mounted therebetween such that said resilient means becomes compressed when said upper and lower ends move apart from one-another while said plowing blade structure is in a lifted or suspended state and such that said resilient means becomes expanded when said upper and lower ends move toward one-another, whereby intermittent shocks of intermittent gravitational pull on predetermined large mass of the plowing blade structure in a lifted state for a motor vehicle's vehicular support structure mounting the vehicular mounting means during movement of the motor vehicle over rough or bumpy terrain is attenuated by intermittent compressions of the resilient means resulting from the intermittent shocks.

2. The motor vehicle plow-device of claim 1, in which said suspension means further includes a flexible elongated structure having opposite proximal and distal ends; and including a retraction means mounted on said vehicular mounting means and the retraction means being connected to said proximal end and said distal end being connected to said upper end, and said lower end being connected to said plowing blade structure such that said flexible elongated structure is at-least partially retractable to retract said distal end with a resulting lifting of said plowing blade structure to a suspended state.

3. The motor vehicle plow-device of claim 2, in which said lower end includes a fastening means for detachably fastening onto said plowing blade structure by which the plowing blade structure is intermittently suspendable from said suspension means, when said retraction means is in an at-least partially retracted state in the retraction of said flexible elongated structure.

4. The motor vehicle plowing-device of claim 3, in which said resilient means has opposite upper and lower portions, said upper and lower ends being structured and positioned such that when said plowing blade structure is suspended as a result of at-least partial retraction of said retraction means, said upper end has a downwardly extending structure as said first compressing structure pressing upwardly against resilient means and said lower end has an upwardly extending structure as said second compressing structure pressing downwardly against said resilient means to thereby exert compressing pressure on said resilient means.

5. The motor vehicle plowing-device of claim 4, in which said resilient means comprises a helical compression spring positioned to be in an at-least partially compressed state between said downwardly extending structure and said upwardly extending structure when said retraction means is in at-least partially retracted state sufficiently for said plowing blade structure to be suspended.

6. The motor vehicle plowing-device of claim 3, in which said fastening means includes first attaching structure and an elongaged lower chain structure having at-least one blade-suspension end and having at an opposite end thereof a suspension-structure end, the suspension structure being permanently a part of said second compressing structure of said lower end and the elongated blade-suspension structure being structured such that the one or more blade-suspension ends thereof are attached or attachable to and supportably suspendable of said plowing blade structure, the blade-suspension structure including attaching structure intermittently engageable with the first attaching structure sufficiently for the fastening means to support the plowing blade structure.

7. The motor vehicle plowing-device of claim 6, in which said elongated blade-suspension structure comprises a link chain, and in which said second attaching structure comprises a link of said link chain.

8. The motor vehicle plow-device of claim 1, in which said lower end includes a fastening means for detachably fastening onto said plowing blade structure by which the plowing blade structure is intermittently suspendable from said suspension means, when said retraction means is in an at-least partially retracted state in the retraction of said flexible elongated structure.

9. The motor vehicle plowing-device of claim 1, in which said suspending means includes an air compression and valve structure for intermittent alternate air intake and compression and exhaust responsive to alternate increases and decreases in stress exerted through the suspending means during upward and downward bouncing movement of the plowing blade structure when in a suspended state during movement of a motor vehicle on which the vehicular mounting means is mounted.

10. The motor vehicle plowing-device of claim 2, in which said resilient means has opposite upper and lower portions, said resilient top and bottom ends being structured and positioned such that when said plowing blade structure is suspended as a result of at-least partial retraction of said retraction means, said upper end has a downwardly extending structure pressing upwardly against said lower portion and said lower end has an upwardly extending structure pressing downwardly against said upper portion to thereby intermittently exert compressing pressure on said resilient means.

11. The motor vehicle plowing-device of claim 10, in which said resilient means comprises a helical compression spring positioned to be in an at-least partially compressed state between said downwardly extending structure and said upwardly extending structure when said retraction means is in at-least partially retracted state sufficiently for said plowing blade structure to be suspended.

12. The motor vehicle plowing-device of claim 4, in which said resilient means comprises a resilient compressible solid rubber composition positioned to be in an at-least partially compressed state between said downwardly extending structure and said upwardly extending structure when said retraction means is in at-least partially retracted state sufficiently for said plowing blade structure to be suspended.

13. The motor vehicle plowing-device of claim 10, in which said resilient means comprises a resilient compressible solid rubber composition positioned to be in an at-least partially compressed state between said downwardly extending structure and said upwardly extending structure when said retraction means is in at-least partially retracted state sufficiently for said plowing blade structure to be suspended.

14. The motor vehicle plowing-device of claim 1, in which said suspension means includes first and second suspension means, the first suspension means including first upper and lower ends and the second suspension means including second upper and lower ends, and the first suspension means including a first flexible elongated structure having opposite a first proximal end and a first distal end, and the second suspension means including a second flexible elongated structure having a second proximal end and a second distal end, and said plowing blade structure extending substantially laterally in opposite direction and having a substantially mid-point intermediate between said opposite directions, and including a retraction means mounted on said vehicular mounting means and the retraction means being connected to each of said first and second proximal ends and said first and second lower ends being connected to said plowing blade structure at substantially laterally spaced-apart locations on plowing blade structure as spaced substantially equally from said substantially mid-point such that said first and second flexible elongated structures are each at-least partially retractable to retract said distal end with a resulting substantially evenly-balanced lifting of said plowing blade structure to a suspended state.

* * * * *